US005280005A

United States Patent [19]

Nakajima et al.

[11] Patent Number: 5,280,005

[45] Date of Patent: Jan. 18, 1994

[54] IMAGE RECEIVING SHEET FOR THERMAL TRANSFER RECORDING

[75] Inventors: Atsushi Nakajima; Shigehiro Kitamura; Tomonori Kawamura; Kunihiro Koshizuka, all of Tokyo, Japan

[73] Assignee: Konica Corporation, Tokyo, Japan

[21] Appl. No.: 937,518

[22] Filed: Aug. 28, 1992

[30] Foreign Application Priority Data

Sep. 10, 1991 [JP] Japan ..... 3-258371

[51] Int. Cl.[5] ..... B41M 5/035; B41M 5/38

[52] U.S. Cl. ..... 503/227; 428/195; 428/212; 428/480; 428/500; 428/913; 428/914

[58] Field of Search ..... 8/471; 428/195, 212, 428/913, 914, 480, 500; 503/227

[56] References Cited

U.S. PATENT DOCUMENTS 4,837,200 6/1989 Kondo et al. ..... 503/227

*Primary Examiner*—B. Hamilton Hess

*Attorney, Agent, or Firm*—Frishauf, Holtz, Goodman & Woodward

[57] ABSTRACT

Disclosed is an image receiving sheet for thermal transfer recording comprising: a support and an image receiving layer thereon, wherein the image receiving layer comprises an outermost layer being farthest from the support and a layer other than the outermost layer, and a glass transition temperature of a first binder used in the outermost layer is higher than that of a second binder used in the layer adjacent to the outermost layer.

15 Claims, No Drawings

IMAGE RECEIVING SHEET FOR THERMAL TRANSFER RECORDING

BACKGROUND OF THE INVENTION

This invention relates to an image receiving sheet for thermal transfer recording, which can receive a thermally transferred dye, more specifically to an image receiving sheet for thermal transfer recording, which can provide a high density transferred image and can maintain the transferred dye image stably relative to heat and light.

In the prior art, there has been known a thermal transfer system in which a dye or an ink is transferred by a heat source such as a thermal head or a laser. Recently, attention has been paid to a thermal transfer system using a sublimable dye (or a thermally diffusible dye). The transfer system using these dyes has an advantage that gradation can be given to picture elements by controlling energy of a heat source, whereby it has been used more widely as a means for obtaining a color image with high image quality.

However, in the sublimation type thermal transfer system, much energy is required to sublimate or thermally diffuse a dye, so that progress of techniques concerning sensitivity has been expected. Further, storage stability of an image is inferior to that of the so-called silver halide photography which has been highly completed, so that high durability of a transferred image has been demanded.

As a means for improving sensitivity, there has been proposed a technique of plasticizing a binder in a dyeing image receiving layer to be used in an image receiving sheet for thermal transfer recording (by adding the so-called heat solvent or internally plasticizing a binder) to improve diffusibility of a dye. However, storage stability of an image relative to heat is worsened due to increased diffusibility of a dye, whereby evil influences such as bleeding of an image are brought about.

Thus, there has been proposed a system in which a chelate type dye is used as a dye to be transferred, and the dye has a small molecular weight during transfer and reacts with a metal compound in an image receiving layer after transfer to form a chelate dye. According to this system, a selection range of a binder can be broadened to a great extent as compared with the case where a conventional dye is used. However, there is a limit in plasticizing a binder in an image receiving layer, and when a glass transition temperature (Tg) is extremely small, there is a problem that blocking of an image receiving sheet for thermal transfer recording is caused.

SUMMARY OF THE INVENTION

An object of the present invention is to provide an image receiving sheet for thermal transfer recording which can improve sensitivity without causing blocking, and also can maintain storage stability of an image.

The present inventors have studied intensively in order to accomplish the above object, and as a result, the present invention has been made.

That is, the image receiving sheet for thermal transfer recording of the present invention is an image receiving sheet for thermal transfer recording comprising: a support and an image receiving layer thereon, wherein the image receiving layer comprises an outermost layer being farthest from the support and a layer other than the outermost layer, and Tg of a first binder used in the outermost layer is higher than Tg of a second binder used in the layer adjacent to the outermost layer. In other words, both prevention of blocking and improvement of sensitivity can be accomplished by providing the outermost layer which does not cause blocking, on an image receiving layer containing a sufficiently plasticized binder and having high sensitivity.

DESCRIPTION OF THE PREFERRED EMBODIMENTS

In the following, the present invention is explained in detail.

Preferred embodiments of the present invention are that (1) difference between Tg of the first binder used in the above outermost layer and Tg of the second binder used in the layer adjacent to the outermost layer is 10° C. or more, (2) Tg of the second binder used in the layer adjacent to the above outermost layer is 50° C. or lower, (3) the above outermost layer contains a UV absorber, (4) the film thickness of the above outermost layer is 0.05 to 2 μm, and (5) a metal ion-containing compound which forms a chelate compound by the reaction with a metal chelate dye is contained.

In the following, the requirements of the present invention are described in detail.

Image receiving sheet for thermal transfer recording

1. Support

A suitable support may differ depending on the purpose of use. For ordinary color image output such as a video printer, there have been generally known an RC paper (a resin-coated paper in a wide sense), Yupo (trade name, produced by Oji Yuka, polypropylene), White-PET (trade name, produced by ICI, including void type) and a laminated product of these. In either case, preferred is a material having characteristics such as small surface roughness, less curling caused by heat and good antistatic property. In the point of sensitivity, it is desired to use a material having small thermal conductivity, and void type polyethylene and polyethylene terephthalate (PET) are preferred. For an identity (ID) card such as a license and a bank card, it is desired to use a material having high mechanical strength, and a PET-laminated material and thick vinyl chloride are preferred.

The support to be used in the present invention is not limited to the materials described above, and there may be used various sheets of resins such as a polypropylene resin, an acrilonitrile-styrene resin, an acrilonitrilebutadiene-styrene resin and a vinyl chloride resin.

In consideration of adhesiveness to an image receiving layer and cushioning, adhesion treatment may be applied to the support, or a cushion layer may be provided thereon. When an RC paper is used, a dye diffusion-preventive layer may be provided. When conductivity of the support is small, an antistatic layer may be provided on the surface opposite to an image receiving layer to prevent static charge.

2. Outermost layer of image receiving layer

The outermost layer of an image receiving layer is a surface adjacent to an ink sheet for thermal transfer recording and receiving a dye, which may satisfy the characteristics to be possessed as in a conventional image receiving layer.

One of the above characteristics is to have suitable dye diffusibility by which a dye can be diffused, and the other is to have sufficient releasing property to peel off an ink sheet smoothly.

In order to impart suitable dye diffusibility, Tg of a binder used actually is preferably made about 60° to 120° C.

As a preferred binder, there may be representatively mentioned a vinyl chloride type resin (polyvinyl chloride or a copolymer mainly composed of vinyl chloride, for example, vinyl chloride-vinyl acetate, vinyl chloride-vinyl propionate, vinyl chloride-ethylene, vinyl chloride-vinylidene chloride and vinyl chloride-isobutyl vinyl ether), a polyester type resin (an aliphatic polyester and an aromatic polyester), a polycarbonate type resin, a polyvinyl acetal type resin (polyvinyl formal, polyvinyl acetoacetal and polyvinyl butyral) and an acrylic resin (including photocuring by an acrylate type resin). It has been well known that these resins are cured by ultraviolet curing or isocyanate curing in order to change surface characteristics. Further, it is effective to introduce an aromatic functional group to improve light resistance of a dye. For example, a vinyl chloride-benzyl methacrylate copolymer, bisphenol type polyester and polyvinyl acetal acetalized by benzyl aldehyde may be included. It is also possible to use a plasticizer to control plasticity of the binder. As the plasticizer, there may be used known plasticizers, for example, an ester type plasticizer, an epoxy type plasticizer and a phosphate type plasticizer.

Sufficient releasing property can be given by imparting releasing property to a main binder (copolymerizing or graft bonding releasable monomers). There may be specifically mentioned a compound in which a silicone compound, a fluorine compound or a long chain alkyl compound is grafted to a polymer of vinyl chloride or a polyester. Further, sufficient releasing property can be given simply and easily by adding the so-called releasing agent. As the effective releasing agent, one having compatibility with a binder to be used is preferred. As a representative example, there may be specifically mentioned a modified silicone oil and a modified silicone polymer, for example, an amino-modified silicone oil, an epoxy-modified silicone oil, a polyester-modified silicone oil, an acryl-modified silicone resin and an urethane-modified silicone resin. Among them, a polyester-modified silicone oil is particularly excellent in the point that fusing with an ink sheet can be prevented, but fabricating quality of an image receiving layer is not lowered. The fabricating quality of an image receiving layer refers to writability with marking ink, laminating property which becomes a problem when an image formed is protected, and others. As the releasing agent, a fine particle such as silica is also effective. When the fabricating quality is not taken into consideration, a curing type silicone compound may be effectively used as a means for preventing fusing. An ultraviolet curing type silicone and a reaction curing type silicone are available, and a great releasing effect can be expected thereby.

In order to improve light resistance of an image, a UV absorber is preferably added to said outermost layer. As the UV absorber, there may be preferred cyano acrylate type, benzotriazole type, benzophenone type, salicylic acid type and cinnamic acid type compounds. Further, a nickel complex is also included.

The film thickness of said outermost layer is preferably 0.05 to 2 μm, more preferably 0.1 to 1.5 μm. If it exceeds 2 μm, desired increase in sensitivity cannot be observed, while if it is less than 0.05 μm, increase in sensitivity can be observed, but a sufficient effect of preventing blocking cannot be obtained.

3. Layer adjacent to outermost layer

In the present invention a main object of which is to increase sensitivity, a layer adjacent to the outermost layer plays an important role particularly in the point of sensitivity. This layer is characterized in that Tg of a binder of this layer is lower than Tg of a binder of the outermost layer. It is preferred for increase of sensitivity that difference between Tgs is 10° C. or more. Tg of the layer adjacent to the outermost layer is preferably 50° C. or lower. As a preferred binder, there may be used the similar or same type of binders as those used in the outermost layer. The film thickness is not limited, but generally 1 to 20 μm. As an additive, there may be used a releasing agent, a UV absorber, a UV stabilizer, a white pigment and a plasticizer.

4. Others

When a metal chelate dye is used in an ink sheet, a metal compound is contained. In the following, a dye to be transferred and a metal ion-containing compound for chelating are described.

a. Metal ion-containing compound

In the present invention, a metal ion-containing compound which forms a chelate compound by the reaction with a sublimable dye is preferably contained in the above image receiving layer and a transparent protective layer. When the metal-ion containing compound is contained in the image receiving layer, a sublimable dye which is diffused into the image receiving layer and this metal ion-containing compound form a chelate and are stabilized, so that stability and storage stability of an image by a sublimable dye are greatly enhanced. This metal ion is a polyvalent metal ion.

As the above polyvalent metal ion, there may be mentioned divalent and polyvalent metal ions belonging to Groups I to VIII of the periodic table. Among them, preferred are $Al^{3+}$, $Co^{2+}$, $Cr^{2+}$, $Cu^{2+}$, $Fe^{2+}$, $Mg^{2+}$, $Mn^{2+}$, $Ni^{2+}$, $Sn^{2+}$, $Ti^{2+}$ and $Zn^{2+}$, and particularly preferred are $Ni^{2+}$, $Cu^{2+}$, $Cr^{2+}$, $Co^{2+}$and $Zn^{2+}$.

As metal ion-containing compounds which provide these polyvalent metals (hereinafter sometimes referred to as "metal source"), there may be mentioned inorganic or organic salts of the polyvalent metals and complexes of the polyvalent metals, and among them, salts and complexes of organic acids are preferred.

As a specific example, there may be mentioned a salt of $Ni^{2+}$, $Cu^{2+}$, $Co^{2+}$ or $Zn^{2+}$ with a lower aliphatic acid such as acetic acid, a salt of a higher aliphatic acid such as stearic acid, or a salt of an aromatic carboxylic acid such as benzoic acid and salicylic acid.

Further, a complex represented by the following formula may be preferably used.

$$(M(Q1)k(Q2)m(Q3)n)^{+}p(Z^{-})p$$

In the above formula, M represents a polyvalent metal ion, preferably $Ni^{2+}$, $Cu^{2+}$, $Cr^{2+}$, $Co^{2+}$ or $Zn^{2+}$.

$Q_1$, $Q_2$ and $Q_3$ each represent a coordination compound which can form a coordinate bond with the polyvalent metal ion represented by M, and may be the same or different from each other.

These coordination compounds may be selected from, for example, coordination compounds described in "Chelete Chemistry" (5) (Nankodo).

Z represents an organic anion, and may specifically include a tetraphenyl boron anion and an alkylbenzenesulfonic acid anion.

k represents 1, 2 or 3, m represents 1, 2 or 0, and n represents 1 or 0. These k, m and n are determined by whether the complex represented by the above formula is tetradentate coordination or hexadentate coordination, or determined by the number of ligands of $Q_1$, $Q_2$ and $Q_3$.

p represents 1 or 2, preferably 2. When p is 2, a coordination group of the coordination compound represented by $Q_1$, $Q_2$ or $Q_3$ is not anionic.

Further, there may be also used metal sources disclosed in Japanese Patent Publication No. 11535/1961, and Japanese Provisional Patent Publications No. 48210/1980 and No. 129346/1980.

The amount of a metal source to be added depends on the amount of a thermally diffusible dye attached to an image recording medium, and for example, it may be preferably 0.5 to 5 times of the total molar amount per each 1 $m^2$ of yellow, magenta and cyan to be used in combination.

b. Dye for chelating

Next, a chelate dye is not particularly limited so long as it is a dye compound containing a group capable of forming a complex with the above metal ion-containing compound, but preferred is a dye compound represented by the following formula (I) or (II).

(I)

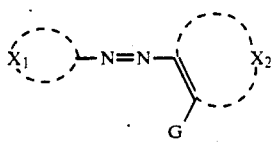

wherein $X_1$ represents a group of atoms necessary for completing an aromatic carbon ring or heterocyclic ring in which at least one ring comprises 5 to 7 atoms, and at least one position adjacent to carbon bonded to the azo bonding is carbon atom, nitrogen atom, oxygen atom or sulfur atom; $X_2$ represents a group of atoms necessary for completing an aromatic carbon ring or heterocyclic ring in which at least one ring comprises 5 to 7 atoms; and G represents a chelating group.

(II)

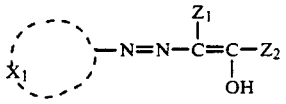

wherein $X_1$ has the same meaning as defined above; $Z_1$ represents an electron attractive group; and $Z_2$ represents an alkyl group or an aryl group.

Specific examples of the thermally diffusible dyes represented by the above formula (I) and formula (II) may include those disclosed in Japanese Provisional Patent Publications No. 78893/1984, No. 109394/1984 and No. 2398/1985, and as a representative example, there may be mentioned compounds represented by the following formulae (I)-1 to (I)-6 and (II)-1.

(I)-1

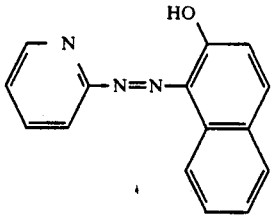

(I)-2

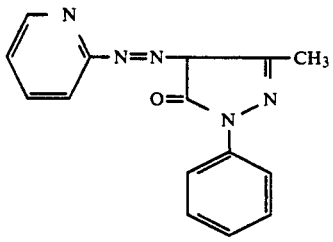

(I)-3

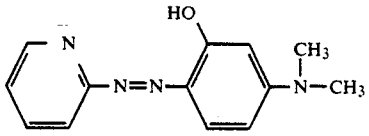

(I)-4

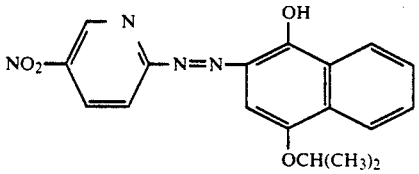

(I)-5

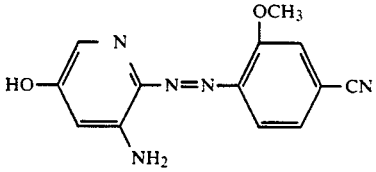

(I)-6

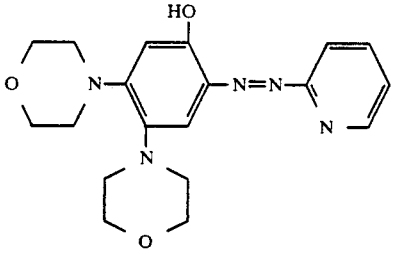

(II)-1

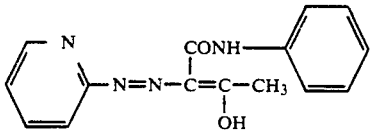

These dyes can be prepared according to synthetic methods disclosed in the above patent publications.

Ink sheet

An ink sheet can be prepared basically by laminating an ink layer on a support.

1. Support

The above support may be any support so long as dimensional stability is good and it can stand heat during recording by a thermal head, and there may be used a tissue paper such as a condenser paper and a glassline paper, and a heat-resistant plastic film such as a polyethylene terephthalate, a polyethylene naphthalate, a polyamide, a polyimide, a polycarbonate, a polysulfone, a polyvinyl alcohol cellophane and a polystyrene.

The thickness of the support is preferably 2 to 10 μm.

The shape of the support is not particularly limited, and may have any desired shape, for example, a wide sheet or film and a slender tape or card.

2. Ink layer a. Thermally diffusible dye

As a thermally diffusible dye, there may be mentioned a cyan dye, a magenta dye and a yellow dye.

As the above cyan dye, there may be mentioned naphthoquinone type dyes, anthraquinone type dyes and azomethine type dyes disclosed in Japanese Provisional Patent Publications No. 78896/1984, No. 227948/1984, No. 24966/1985, No. 53563/1985, No. 130735/1985, No. 131292/1985, No. 239289/1985, No. 19396/1986, No. 22993/1986, No. 31292/1986, No. 31467/1986, No. 35994/1986, No. 49893/1986, No. 148269/1986, No. 191191/1987, No. 91288/1988, No. 91287/1988 and No. 290793/1988.

As the above magenta dye, there may be mentioned anthraquinone type dyes, azo dyes and azomethine type dyes disclosed in Japanese Provisional Patent Publications No. 78896/1984, No. 30392/1985, No. 30394/1985, No. 253595/1985, No. 262190/1986, No. 5992/1988, No. 205288/1988, No. 159/1989 and No. 63194/1989.

As the yellow dye, there may be mentioned methine type dyes, azo type dyes, quinophthalone type dyes and anthraisothiazole type dyes disclosed in Japanese Provisional Patent Publications No. 78896/1984, No. 27594/1985, No. 31560/1985, No. 53565/1985, No. 12394/1986 and No. 122594/1988.

As the thermally diffusible dye, particularly preferred are an azomethine dye obtained by the coupling reaction of a compound having an open or closed type active methylene group with an oxidized product of a p-phenylenediamine derivative or an oxidized product of a p-aminophenol derivative, or an indoaniline dye obtained by the coupling reaction of the compound with phenol or an oxidized product of a naphthol derivative or a p-phenylenediamine derivative or an oxidized product of a p-aminophenol derivative.

The thermally diffusible dye to be contained in the ink layer may be either a yellow dye, a magenta dye or a cyan dye if an image to be formed is monochromatic.

When a metal ion-containing compound is contained in an image receiving layer of an image receiving sheet for thermal transfer recording, the thermally diffusible dye is preferably a dye compound which can form a chelate with the above metal ion-containing compound.

As the dye compound which can form a chelate with the metal ion-containing compound, those described above may be used.

The amount of the above thermally diffusible dye to be added is generally 0.1 to 20 g, preferably 0.2 to 5 g per 1 $m^2$ of a support.

b. Binder resin

As a binder resin of the ink layer, there may be mentioned a cellulose type resin such as a cellulose addition compound, cellulose ester and cellulose ether, polyvinyl alcohol, a polyvinyl acetal resin such as polyvinyl formal, polyvinylacetoacetal and polyvinyl butyral, a vinyl type resin such as polyvinyl pyrrolidone, polyvinyl acetate, polyacrylamide, a styrene type resin, poly(meth)acrylate type, poly(meth)acrylic acid and a (meth)acrylate copolymer, a rubber type resin, an ionomer resin, an olefin type resin and a polyester resin.

Among these resins, preferred is polyvinyl butyral, polyvinyl acetoacetal or a cellulose type resin having excellent storage stability.

The above respective binders may be used singly or in combination of two or more kinds.

The weight ratio of the binder to the above thermally diffusible dye is preferably 1:10 to 10:1, particularly preferably in the range of 2:8 to 7:3.

c. Other optional components

Further, various additives may be suitably added to the above ink layer.

As the additives, there may be mentioned a filler such as metal fine powder, silica gel, metal oxide, carbon black and resin fine powder, and a curing agent which can react with a binder component (e.g. isocyanates and radioactive compounds such as acryls and epoxies).

As the additives, there may be additionally mentioned a thermally fusible substance which accelerates transfer, for example, a compound as disclosed in Japanese Provisional Patent Publication No. 106997/1984 such as a wax and higher aliphatic acid ester.

For the purpose of preventing fusing, various releasing agents may be used, and there may be effectively used, for example, a polyoxyalkylene silicone polymer disclosed in Japanese Provisional Patent Publication No. 262189/1986, a fluorine-containing polymer disclosed in Japanese Provisional Patent Publication No. 1589/1989, an amide-modified silicone oil disclosed in Japanese Provisional Patent Publication No. 85792/1989, and a releasable segment graft polymer disclosed in International Provisional Patent Publication No. 14961/1990. These modified silicone compounds have good compativility with the binder to be used, so that the silicone compounds do not bleed out to the surface of the ink layer.

Layer structure

The ink sheet for thermal transfer recording of the present invention is not limited to a two layer structure comprising a support and an ink layer so long as the above ink layer is laminated on the above support. Other layers may be formed on the support.

The ink layer is not limited to a single layer, and may comprise plural layers. For example, for the purpose of preventing fusing with the image receiving sheet for thermal transfer recording and bleed through (blocking) of the thermally diffusible dye, an overcoat layer having small dye content may be provided on the surface of the ink layer, or for the purpose of enhancing adhesiveness between the support or a subbing layer and the ink layer, a lower ink layer having small dye content may be provided.

Further, the support may have a subbing layer for the purposes of improving adhesiveness to the binder and preventing transfer and dyeing of a dye to the support side.

On the back surface (opposite side to the ink layer) of the support, a sticking preventive layer may be provided for the purpose of preventing fusing and sticking of a head to the support and wrinkling of the ink sheet for thermal transfer recording.

The thicknesses of the above overcoat layer, subbing layer and sticking preventive layer are each generally 0.1 to 1 μm.

Image formation

In order to form an image, the ink layer of the ink sheet for thermal transfer recording is superposed on the image receiving layer of the image receiving sheet for thermal transfer recording, and heat energy is applied imagewisely to the interface of the ink layer and the image receiving layer.

Then, the thermally diffusible dye in the ink layer is thermally diffused or sublimated in an amount corresponding to the heat energy applied during the above image formation, and transferred to and received by the image receiving layer side, whereby a dye image (chelate dye image) is formed on the image receiving layer.

EXAMPLES

In the following, the present invention is described in detail by referring to Examples, but the present invention is not limited to these Examples. In the following, "part" means "part by weight".

EXAMPLE 1

Preparation of image receiving sheet for thermal transfer recording

A coating solution for forming an image receiving layer comprising the following composition was coated on White PET W400 (trade name, produced by Diafoil Co., thickness: 125 μm) so as to have a dried film thickness of 4 μm.

Coating solution for forming image receiving layer:

| | |
|---|---|
| Polyester resin Vylon 300 (trade name, produced by Toyobo K.K.). Tg = 7° C. | 10 parts |
| Methyl ethyl ketone | 45 parts |
| Toluene | 45 parts |

The following coating solution was prepared as the outermost layer, and coated on the above image receiving layer so as to have a dried film thickness of 0.5 μm.

Coating solution for forming outermost layer:

| | |
|---|---|
| Vinyl chloride resin, Tg = 80° C. | 10 parts |
| Releasing agent, silicone compound X24-8300 (trade name, produced by Shinetsu Kagaku K.K., polyester-modified silicone) | 0.5 part |
| Methyl ethyl ketone | 60 parts |
| Cyclohexanone | 20 parts |

Preparation of ink sheet for thermal transfer recording

On the surface subjected to easy adhesion treatment of a polyethylene terephthalate film K203E 6F (trade name, produced by Diafoil K.K.) with a thickness of 6 μm used as a support, a coating solution for forming an ink layer having the following composition was so coated by a wire bar coating method that a thickness after drying became 1 μm, and dried. Then, on the back surface of an ink layer, one drop or two drops of a nitrocellulose solution containing a silicone resin SP-2105 (trade name, produced by Dainichi Seika Kogyo K.K.) was/were dropped and spread on the whole surface to conduct back surface treatment coating, whereby an ink sheet for thermal transfer recording was obtained.

Coating solution for forming ink layer:

| | |
|---|---|
| Thermally diffusible dye Kayaset Blue 714 (trade name, produced by Nihon Kayaku K.K.) | 5 parts |
| Polyvinyl acetal resin KS-5Z (trade name, produced by Sekisui Kagaku K.K.) | 5 parts |
| Methyl ethyl ketone | 90 parts |
| Cyclohexanone | 100 parts |

Image formation

The above ink sheet for thermal transfer recording and the above image receiving sheet for thermal transfer recording were so superposed that the ink layer surface of the former was brought into contact with the image receiving layer surface of the latter, and printing was carried out by using a sublimation type thermal transfer printer.

Image recording was carried out by heating under the following conditions.

| | |
|---|---|
| Output: | 0.4 W/dot |
| Pulse width: | 0.3 to 10 msec |
| Dot density: | 6 dot/mm |

Then, the maximum density, blocking and image storage stability were evaluated. The results are shown in Table 1.

EXAMPLE 2

By using the following coating solution for forming an image receiving layer, coating solution for forming the outermost layer and coating solution for forming an ink layer, an image receiving sheet and an ink sheet for thermal transfer recording were prepared and transfer was carried out in the same manner as in Example 1. Subsequently, the image was treated by heating at 120° C. for 10 minutes, and evaluated in the same manner as in Example 1. The results are shown in Table 1.

Coating solution for forming image receiving layer:

| | |
|---|---|
| Metal compound for chelating, $[Ni^{2+}(NH_2COCH_2NH_2)_3.2(B(C_6H_5)_4^-)_2]$ | 3 parts |
| Plasticized vinyl chloride Esmedica V5142E (trade name, produced by Sekisui Kagaku K.K.), Tg = 0° C. or lower | 7 parts |
| Methyl ethyl ketone | 80 parts |
| Cyclohexanone | 20 parts |

Coating solution for forming outermost layer:

| | |
|---|---|
| Vinyl chloride resin, Tg = 80° C. | 10 parts |
| Releasing agent, silicone compound X24-8300 (trade name, produced by Shinetsu Kagaku K.K., polyester-modified silicone) | 0.5 part |
| Methyl ethyl ketone | 60 parts |
| Cyclohexanone | 20 parts |

Coating solution for forming ink layer:

| | |
|---|---|
| Thermally diffusible dye | 5 parts |

-continued

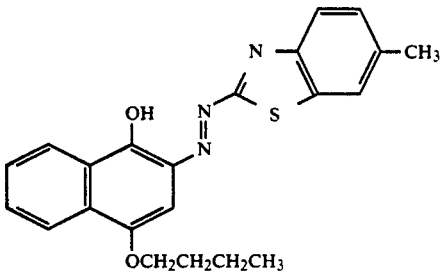

| | |
|---|---|
| Polyvinyl acetal resin KS-5Z (trade name, produced by Sekisui Kagaku K.K.) | 5 parts |
| Modified silicone oil TSF-4700 (trade name, produced by Toshiba Silicone K.K., amino-modified silicone oil) | 0.1 part |
| Methyl ethyl ketone | 90 parts |
| Cyclohexanone | 100 parts |

EXAMPLE 3

The procedures were carried out in the same manner as in Example 1 except for incorporating a UV absorber into the coating solution for forming the outermost layer of Example 1 and changing a dried film thickness to 1.5 μm.

Coating solution for forming outermost layer:

| | |
|---|---|
| Vinyl chloride resin, Tg = 80° C. | 8 parts |
| UV absorber UVINUL-N35 (trade name, produced by BASF Co., cyanoacrylate type UV absorber) | 2 parts |
| Releasing agent, silicone compound X24-8300 (trade name, produced by Shinetsu Kagaku K.K., polyester-modified silicone) | 0.5 part |
| Methyl ethyl ketone | 60 parts |
| Cyclohexanone | 20 parts |

EXAMPLE 4

The procedures were carried out in the same manner as in Example 1 except for changing the coating solution for forming an image receiving layer of Example 1 to a solution having the following composition.

Coating solution for forming image receiving layer:

| | |
|---|---|
| Polyester resin Vylon 103 (trade name, produced by Toyobo K.K.), Tg = 47° C. | 10 parts |
| Methyl ethyl ketone | 45 parts |
| Toluene | 45 parts |

COMPARATIVE EXAMPLE 1

The procedures were carried out in the same manner as in Example 1 except for not forming the outermost layer. The results of evaluation are shown in Table 1.

COMPARATIVE EXAMPLE 2

The procedures were carried out in the same manner as in Example 1 except for changing the coating solution for forming an image receiving layer and the coating solution for forming the outermost layer of Example 1 to solutions having the following compositions, respectively. The evaluation results are shown in Table 1.

Coating solution for forming image receiving layer:

| | |
|---|---|
| Vinyl chloride resin, Tg = 80° C. | 10 parts |
| Releasing agent, silicone compound X24-8300 (trade name, produced by Shinetsu Kagaku K.K., polyester-modified silicone) | 0.5 part |
| Methyl ethyl ketone | 60 parts |
| Cyclohexanone | 20 parts |

Coating solution for forming outermost layer:

| | |
|---|---|
| Vinyl chloride type resin Vinylite VYHH (trade name, produced by Union Carbide Co.), Tg = 72° C. | 10 parts |
| Methyl ethyl ketone | 45 parts |
| Toluene | 45 parts |

Evaluation standard

Evaluation I (transfer density)

Cyan density of the maximum density portion was measured by reflection density.

○: Reflection density exceeds 2.4.
Δ: Reflection density is 2.2 to 2.4.
X: Reflection density is less than 2.2.

Evaluation II (Blocking property)

The image receiving layer was confronted with a polyester sheet, and pressed with a load of 40 g/cm$^2$. After storage at 60° C. for 48 hours, whether the surface of the image receiving layer was blocked or not was observed.

○: No blocking occurred.
Δ: Slight blocking occurred.
X: Blocking occurred.

Evaluation III (durability of image)

After the maximum density portion of the transferred image was stored in a thermostat chamber at 77° C. and a humidity of 80% for 3 days, fading of the image was examined.

○: Both color shift and fading were small.
Δ: Both color shift and fading were slightly observed.
X: Both color shift and fading were significant.

Evaluation IV (bleeding)

After the maximum density portion of the transferred image was stored in a thermostat chamber at 77° C. and a humidity of 80% for 10 days, whether bleeding of the image was present or absent was examined.

○: Almost no dye bled, and the image was sharp.
Δ: Dyes bled a little, and the image slightly blurred.
X: Dyes bled, and the image blurred.

Evaluation V (light resistance of image)

The maximum density portion of the transferred image was stored in a xenon weather meter for 3 days, fading of the image was evaluated.

○: Both color shift and fading were small.
Δ: Both color shift and fading were slightly observed.
X: Both color shift and fading were significant.

TABLE 1

| | Evaluation I | Evaluation II | Evaluation III | Evaluation IV | Evaluation V |
|---|---|---|---|---|---|
| Example 1 | ○ | ○ | ○ | Δ | Δ |
| Example 2 | ○ | ○ | ○ | ○ | ○ |
| Example 3 | ○ | ○ | ○ | Δ | ○ |
| Example 4 | Δ | ○ | ○ | ○ | Δ |

TABLE 1-continued

| | Evaluation I | Evaluation II | Evaluation III | Evaluation IV | Evaluation V |
|---|---|---|---|---|---|
| Comparative example 1 | ○ | X | ○ | X | X |
| Comparative example 2 | X | ○ | ○ | ○ | ○ |

According to the present invention, sensitivity of a sheet for thermal transfer recording can be improved without causing blocking, and also durability and light resistance of an image can be improved by using a metal chelate type dye or using a UV absorber.

We claim:

1. An image receiving sheet for thermal transfer recording comprising: a support and an image receiving layer thereon, wherein the image receiving layer comprises an outermost layer being farthest from the support and a layer adjacent to the outermost layer, and the glass transition temperature of a first binder used in the outermost layer is higher than that of a second binder used in the layer adjacent to the outermost layer.

2. The sheet of claim 1 wherein the difference between the glass transition temperature of the first binder used in the outermost layer and that of the second binder used in the layer adjacent to the outermost layer is 10° C. or more.

3. The sheet of claim 2 wherein the glass transition temperature of the first binder used in the outermost layer is 60° to 120° C.

4. The sheet of claim 3 wherein the glass transition temperature of the second binder used in the layer adjacent to the outermost layer is 50° C. or lower.

5. The sheet of claim 4 wherein the outermost layer contains UV absorber.

6. The sheet of claim 5 wherein the film thickness of the outermost layer is 0.05 to 2 μm.

7. The sheet of claim 6 wherein the sheet contains a metal ion-containing compound which forms a chelate compound by the reaction with a metal chelate dye.

8. The sheet of claim 4 wherein the film thickness of the outermost layer is 0.05 to 2 μm.

9. The sheet of claim 4 wherein each of said first and said second binder is selected from the group consisting of vinyl chloride-benzyl methacrylate, a bisphenol polyester, and polyvinyl acetal acetalized by benzyl aldehyde.

10. The sheet of claim 1 wherein the glass transition temperature of the first binder used in the outermost layer is 60° to 120° C.

11. The sheet of claim 1 wherein the glass transition temperature of the second binder used in the layer adjacent to the outermost layer is 50° C. or lower.

12. The sheet of claim 1 wherein the outermost layer contains a UV absorber.

13. The sheet of claim 1 wherein the film thickness of the outermost layer is 0.05 to 2 μm.

14. The sheet of claim 1 wherein the sheet contains a metal ion-containing compound which forms a chelate compound by the reaction with a metal chelate dye.

15. The sheet of claim 14 wherein the metal ion is selected from the group consisting of $Al^{3+}$, $Co^{2+}$, $Cr^{2+}$, $Cu^{2+}$, $Fe^{2+}$, $Mg^{2+}$, $Mn^{2+}$, $Ni^{2+}$, $Sn^{2+}$, $Ti^{2+}$ and $Zn^{2+}$.

* * * * *